US006234760B1

(12) United States Patent
Popov et al.

(10) Patent No.: US 6,234,760 B1
(45) Date of Patent: May 22, 2001

(54) PUMPING-EJECTION APPARATUS AND VARIANTS

(76) Inventors: Serguei A. Popov, 4615 Post Oak Pl., Suite 140, Houston, TX (US) 77027; Anatoli M. Doubinski, Flat 96, 6, Volokolamskoe Shosse, Moscow (RU), 125080

( * ) Notice: Subject to any disclaimer, the term of this patent is extended or adjusted under 35 U.S.C. 154(b) by 0 days.

(21) Appl. No.: 09/242,403

(22) PCT Filed: Jun. 8, 1998

(86) PCT No.: PCT/IB98/00890

§ 371 Date: Feb. 16, 1999

§ 102(e) Date: Feb. 16, 1999

(87) PCT Pub. No.: WO98/58176

PCT Pub. Date: Dec. 23, 1998

(30) Foreign Application Priority Data

Jun. 16, 1997 (RU) ..... 97109382

(51) Int. Cl.[7] ..... F04F 5/54

(52) U.S. Cl. ..... 417/65; 203/94

(58) Field of Search ..... 55/396, 170, 97; 62/500; 137/888; 203/94; 208/355; 406/93; 417/65, 54, 179, 104, 169, 69; 549/250, 262; 564/71

(56) References Cited

U.S. PATENT DOCUMENTS

| | | | | |
|---|---|---|---|---|
| 3,884,660 | * | 5/1975 | Perry, Jr. et al. | 55/396 |
| 3,898,017 | * | 8/1975 | Mandorian | 417/65 |
| 3,965,123 | * | 6/1976 | Franklin | 549/262 |
| 4,113,450 | * | 9/1978 | Goransson et al. | 55/97 |
| 4,207,256 | * | 6/1980 | Inoue et al. | 564/71 |
| 4,269,776 | * | 5/1981 | Keunecke et al. | 549/250 |
| 4,354,805 | * | 10/1982 | Bauer | 417/54 |
| 4,358,249 | * | 11/1982 | Hanson | 417/179 |
| 4,415,443 | * | 11/1983 | Murphy | 208/355 |
| 4,449,862 | * | 5/1984 | Beck | 406/93 |
| 4,484,457 | * | 11/1984 | Mugele | 62/500 |
| 4,701,108 | * | 10/1987 | Scampini | 417/104 |
| 4,746,335 | * | 5/1988 | Reimann et al. | 55/170 |
| 4,761,970 | * | 8/1988 | MacCracken | 62/500 |
| 4,932,842 | * | 6/1990 | Dietrick et al. | 417/169 |
| 5,006,046 | * | 4/1991 | Buckman et al. | 417/54 |
| 5,595,477 | * | 1/1997 | Aminger | 417/69 |
| 5,980,698 | * | 11/1999 | Abrosimov | 203/94 |
| 6,016,840 | * | 1/2000 | Popov et al. | 137/888 |

FOREIGN PATENT DOCUMENTS

| | | |
|---|---|---|
| 2016268 | 7/1994 | (RU) . |
| 2048156 | 11/1995 | (RU) . |
| 1195074 | 11/1985 | (SU) . |
| 1588925 | 8/1990 | (SU) . |
| 1733714 | 5/1992 | (SU) . |

* cited by examiner

*Primary Examiner*—Teresa Walberg
*Assistant Examiner*—L Fastovsky
(74) *Attorney, Agent, or Firm*—Mark A. Oathout

(57) ABSTRACT

The invention relates to the field of jet technology, primarily to apparatus for evacuation and gaseous mediums' compression.

Apparatus is furnished by liquid-gas ejector, pump, separator and condenser. Ejector contains receiving chamber, which has a space in the zone of inlet part of mixing chamber for collecting of outlying part of liquid working medium's flow and its discharge through the drain pipe, which can be connected to separator or to the suction side of pump.

The introduced design of installation allows to increase its efficiency factor.

7 Claims, 1 Drawing Sheet

PUMPING-EJECTION APPARATUS AND VARIANTS

TECHNICAL FIELD

The invention relates to the field of jet technology, particularly to apparatus for creation of vacuum primarily in vacuum rectifying columns, and for compression of different gaseous mediums.

BACKGROUND ART

There is a pumping-ejection installation known, which contains ejector, working liquid pump and separator. Pump is connected to ejector, ejector's branch pipe for passive medium's feed is connected to gas pipeline, and separator is connected to ejector's outlet and pump's suction side (see SU, author's certificate, 1195074, cl.f 04 f 5/54,1985).

This installation allows to pump out different gases by using a closed circuit of working liquid circulation, however the energy of liquid medium is not fully used in this apparatus while gaseous medium's evacuation, what reduces the effectiveness of its operation.

The closest analogy to the described installation, in technical way, is pumping-ejection unit, which contains liquid-gas ejector with passive medium's feed device, mixing chamber and nozzle, pump, connected by its discharge side to ejector's nozzle and separator, connected by its liquid outlet to the pump suction side, inlet of passive medium's feed device of the ejector is connected to evacuated gaseous medium's source (see RU, patent, 2016268, cl. F 04 f 5/54,1994).

By means of optimisation of liquid-gas jet apparatus operation it becomes possible in this case to evacuate different gaseous mediums, creating vacuum in evacuated space in this manner, and to compress evacuated gaseous medium. Nevertheless, rather big losses of energy of liquid working medium take place during this liquid-gas jet apparatus operation because of irrational redistribution of energy of liquid working medium at the first stage of its interaction with evacuated gaseous medium.

DISCLOSURE OF INVENTION

The problem to be solved in this invention is increase of efficiency factor of ejector pumping installation by reducing energy losses of liquid working medium in liquid-gas ejector.

The mentioned problem is solved by the following: in ejector pumping installation, which contains liquid-gas ejector with passive medium's feed device, mixing chamber and nozzle, pump, connected by its suction side to ejector's nozzle and separator, connected by its liquid outlet to the pump suction side, inlet of passive medium's feed device of the ejector is connected to evacuated gaseous medium's source, and the installation is also furnished by condenser, passive medium's feed device is designed as a receiving chamber. Nozzle and mixing chamber are situated in alignment from the opposite sides of receiving chamber. Wall of inlet part of mixing chamber together with walls of receiving chamber form a space (it can be a circular space, for example), which is connected to separator by drain pipe. The outlet cross-section of drain pipe is located below liquid's level in separator and forms hydraulic lock. Ejector's outlet is connected to condenser, which is in turn, connected to separator's inlet.

There is another variant of design of ejector pumping installation, which contains liquid-gas ejector with passive medium's feed device, mixing chamber and nozzle, pump, connected by its suction side to ejector's nozzle and separator, connected by liquid outlet to the pump suction side, note that inlet of passive medium's feed device of the ejector is connected to evacuated gaseous medium's source, and also apparatus is supplied with condenser, passive medium's feed device is designed as a receiving chamber. Nozzle and mixing chamber are situated in alignment from the opposite sides of the receiving chamber. Wall of inlet part of mixing chamber together with walls of receiving chamber form a space (it can be a circular space), which is connected to pump suction side. Ejector's outlet is connected to condenser, and condenser is connected to separator's inlet.

Besides, the inlet part of mixing chamber, by means of which space in receiving chamber is formed, can be designed in the form of shell, converging in flow direction. This space in the receiving chamber can be situated above the separator, not lower than height of barometric liquid column in drain pipe, and the inlet cross-section of drain pipe is situated lower than the inlet of evacuated medium in receiving chamber.

Researches of liquid-gas ejector operation showed, that during nozzle outflow (single-channel or multiply-channel), the outlying part of liquid working medium's flow, mostly made up of fine drops, when contacting with evacuated gas, loses kinetic energy much faster than the rest part of liquid working medium's flow. While hitting with particles, which are forming evacuated gas, the outlying part of liquid flow is sprayed in receiving chamber and is accumulated in the inlet part of mixing chamber. The sprayed part of the liquid working medium's flow starts to drain into the mixing chamber due to influence of gas flow and pressure gradient and partly blocks flow area of the mixing chamber. As a result, the energy of not-sprayed part of liquid working medium's flow is being spent not only for gaseous medium's evacuation, but also for pumping this sprayed part of liquid working medium's flow out. All the above finally decreases efficiency of liquid-gas ejector operation and efficiency of the whole ejector pumping installation accordingly.

Availability of space (for example circular space) with drain pipe in receiving chamber of liquid-gas ejector allows to collect the sprayed part of liquid working medium's flow in the receiving chamber and to discharge it from there, depending on conditions of apparatus operation, either to separator or to pump suction side with its further mixing with the main part of liquid working medium. So, energy of liquid working medium is mainly used for evacuating and compression of evacuated gas medium. Besides, the losses of liquid working medium are excluded, as after discharge from the ejector the sprayed part of liquid working medium returns into circulation circuit.

It is advisable to design the inlet part of mixing chamber, which forms space in the receiving chamber, as a conic shell, converging in medium's flow direction. This prevents draining of the sprayed part of liquid working medium into mixing chamber, if ejector is situated horizontally or inclined. It also prevents placing of the drain pipe's inlet cross-section lower than the inlet of evacuated gaseous medium of the receiving chamber.

If conditions allow, for example vertical configuration of ejector pumping installation, it is advisable to bleed the sprayed part of liquid working medium by gravity. In this case, the space in the receiving chamber should be situated above the separator, but not lower than barometric liquid column in the drain pipe.

If ejector pumping installation is used as a compressor unit, no matter if it creates vacuum in evacuated volume or not, it is preferable to discharge the sprayed part of liquid working medium's flow from the receiving chamber to the pump suction side, which will actually pump it out from the receiving chamber.

As a result the solution of the problem is achieved by this invention.

BRIEF DESCRIPTION OF DRAWINGS

The drawing represents basic diagram of the ejector pumping installation, where both variants of its design are implemented.

Ejector pumping installation contains liquid-gas ejector 1, which includes device 2 for feed of passive medium, mixing chamber 3 and nozzle 4, pump 5, connected by its discharge side with nozzle 4 of ejector 1, and separator 6, connected by its liquid outlet with suction side of pump 5, inlet of device 2 for passive medium's feed in ejector 1 is connected to evacuated gaseous medium's source. Installation is furnished by condenser 7, device 2 of passive medium's feed is designed as receiving chamber, and nozzle 4 and mixing chamber 3 are located in alignment from its opposite sides. Mixing chamber is situated in such a way, that its wall 8 of the inlet part together with walls of receiving chamber 2 form space 9, for example, circular space, which is connected to separator 6 by drain pipe 10. The outlet cross-section of drain pipe 10 is located lower than the level of liquid in separator 6, what makes hydraulic lock. Ejector 1 is connected by its outlet to condenser 7, and condenser 7 is connected to the inlet of separator 6.

Figure 1:
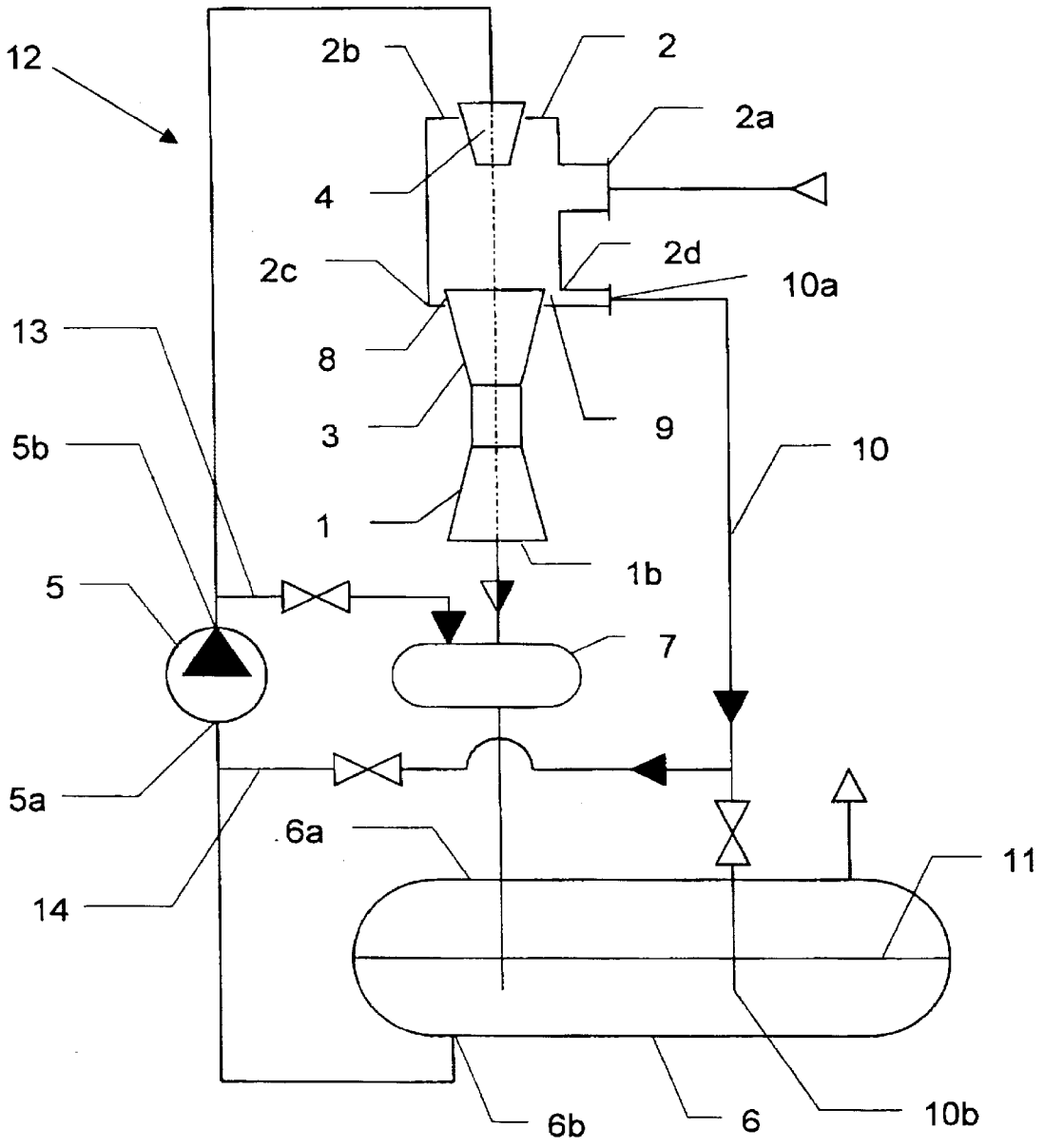

Space 9 of receiving chamber 2 is connected to the suction side of pump 5, wall 8 of inlet part of mixing chamber 3 is designed in the form of shell, converging in flow direction, for example, conic shell. Nevertheless, depending on the mode of ejector's operation and its attitude position, this inlet area can be cylindrical or diverging in medium's flow direction.

Space 9 in receiving chamber 2 is located above separator 6, not lower than height of barometric liquid column in drain pipe 10, the inlet cross-section of drain pipe 10 is located, mainly, lower than inlet of evacuated gaseous medium in receiving chamber 2.

Installation operates in the following way.

Liquid working medium is delivered by pump 5 from separator 6 to nozzle 4 of liquid-gas ejector 1. Liquid working medium flows from nozzle 4 and entrains evacuated gaseous medium from receiving chamber 2 to mixing chamber 3. Simultaneously, during discharge of liquid working medium from nozzle 4 and its mixing with evacuated gaseous medium the outlying part of liquid working medium's flow is sprayed in receiving chamber 2, and in the case of vertical position of ejector 1, either drains down the walls of receiving chamber 2, or settles under its own weight in space 9, from which through drain pipe 10 drains into separator 6. At the same time evacuated gaseous medium is compressed in mixing chamber 3 by liquid working medium's kinetic energy and mixes with liquid working medium forming liquid-gas mixture. This liquid-gas mixture gets from ejector 1 into condenser 7, where the process of transformation of easy condensable components of evacuated and compressed gaseous medium into liquid condition is occurred. If stimulation of condensation process is necessary, delivery of part of liquid working medium from discharge side of pump 5 to condenser 7 is possible. Condensation process in condenser 7 allows to reduce content of gaseous phase in liquid-gas mixture and, as a result, to reduce energy losses during liquid-gas mixture proceeding from ejector 1 to separator 6. In some cases, for example while pumping out of hydrocarbon gases, condensation process allows to increase output of liquid hydrocarbons and, consequently, to increase effectiveness of this installation. In separator 6 liquid-gas mixture is separated into liquid working medium and compressed gas, which is discharged from separator 6 to the consumers, and liquid working medium is tapped from separator 6 to the suction side of pump 5 for further delivery into nozzle 4 of ejector 1.

In some cases, for example while using this installation as a compressor, there is no possibility to arrange discharge of sprayed liquid working medium's part from receiving chamber 2 by gravity because of big differential pressure. Then space 9 in receiving chamber 2 is connected to the suction side of pump 5. In this variant of installation's operation pump 5 simultaneously pumps liquid working medium out both from receiving chamber 2 and from separator 6 and then feeds liquid working medium to nozzle 4 of ejector 1. In all other respects, operation of the installation is the same with the described one.

When ejector 1 is located inclined or horizontally, it is advisable to design wall 8 of inlet part of mixing chamber 3 in the form of shell, converging in flow direction. At the same time it would be advisable to place the inlet cross-section of drain pipe in the lowest point of space 9 and lower than the inlet of evacuated gaseous medium in receiving chamber 2. Such a design of ejector 1 prevents ingress of liquid working medium in mixing chamber 3, which drains off the end wall of receiving chamber 2 in the zone of inlet part of mixing chamber 3.

INDUSTRIAL APPLICABILITY

The invention can be used in chemical, petrochemical and some other industries.

What is claimed is:

1. A pumping-ejector unit comprising a liquid-gas ejector having a device for passive medium feed connected by an inlet to a source of an evacuated gaseous medium, a mixing chamber and a nozzle; a pump connected by an outlet to the nozzle; and a separator having a liquid outlet connected to a suction side of the pump, further including:

a condenser connected to an outlet of the ejector and connected to an inlet of the separator;

wherein the device for passive medium feed comprises a receiving chamber having a first side, a second side opposite the first side, and a wall;

wherein the nozzle is placed in the first side and the mixing chamber is placed in the second side in alignment with the nozzle;

wherein the mixing chamber has an inlet section formed by another wall in the receiving chamber;

wherein the inlet section wall of the mixing chamber together with the wall of the receiving chamber define a pocket; and a drain pipe connecting the pocket of the receiving chamber to the separator wherein an outlet cross-section of the drain pipe is located lower than a level of a volume of liquid in the separator whereby a hydro seal is formed.

2. The pumping-ejector unit according to claim 1, wherein the inlet section of the mixing chamber defining the pocket in the receiving chamber comprises a conic shell converging in a flow direction.

3. The pumping-ejector unit according to claim 1, wherein the pocket in the receiving chamber is located above the separator and not lower than a height of a barometric liquid column in the drain pipe.

4. The pumping-ejector unit according to claim 1, wherein an inlet cross-section of the drain pipe is located lower than the inlet to the device for the evacuated gaseous medium.

5. A pumping-ejector unit comprising a liquid-gas ejector having a device for passive medium feed connected by an inlet to a source of an evacuated gaseous medium, a mixing chamber and a nozzle; a pump connected by an outlet to the nozzle; and a separator having a liquid outlet connected to a suction side of the pump, further including:

a condenser connected to an outlet of the ejector and connected to an inlet of the separator;

wherein the device for passive medium feed comprises a receiving chamber having a first side, a second side opposite the first side, and a wall;

wherein the nozzle is placed in the first side and the mixing chamber is placed in the second side in alignment with the nozzle;

wherein the mixing chamber has an inlet section formed by another wall in the receiving chamber;

wherein the inlet section wall of the mixing chamber together with the wall of the receiving chamber define a pocket; and a drain pipe connecting the pocket of the receiving chamber to the pump.

6. The pumping-ejector unit according to claim 5, wherein the inlet section wall, situated in the receiving chamber, converges in a flow direction.

7. The pumping-ejector unit according to claim 5, wherein an inlet cross-section of the drain pipe is located lower than the inlet to the device for evacuated gaseous medium.

* * * * *